US005904230A

United States Patent [19]

Peterson

[11] Patent Number: 5,904,230

[45] Date of Patent: May 18, 1999

[54] FOLDABLE CONTAINER

[75] Inventor: Leroy L. Peterson, Omaha, Nebr.

[73] Assignee: Sportsstuff Inc., Omaha, Nebr.

[21] Appl. No.: 09/048,411

[22] Filed: Mar. 26, 1998

[51] Int. Cl.[6] ..... A45C 7/00; A45C 11/20; A45C 13/10

[52] U.S. Cl. ..... 190/107; 383/4

[58] Field of Search ..... 190/2, 107; 383/4; 229/112

[56] References Cited

U.S. PATENT DOCUMENTS

| | | | |
|---|---|---|---|
| 621,824 | 3/1899 | Kleeman | 190/107 |
| 1,040,300 | 11/1912 | Fitzgerald | 190/107 |
| 2,768,719 | 10/1956 | Samuel | 190/107 |
| 2,831,624 | 4/1958 | Lever | 383/4 |
| 3,173,465 | 3/1965 | Pastini | 190/107 X |
| 3,246,829 | 4/1966 | Sexton | 229/179 X |
| 3,545,667 | 12/1970 | Vjecsner | 229/179 X |
| 4,235,346 | 11/1980 | Liggett | 220/7 |
| 4,489,815 | 12/1984 | Martinez et al. | 190/107 X |
| 4,601,425 | 7/1986 | Bachner | 229/179 |
| 4,679,242 | 7/1987 | Brockhaus | 190/107 X |
| 4,846,398 | 7/1989 | Johnson | 229/179 X |
| 4,951,868 | 8/1990 | Mode | 229/112 |
| 4,984,906 | 1/1991 | Little | 190/107 X |
| 5,284,294 | 2/1994 | Floyd | 229/179 |

*Primary Examiner*—Sue A. Weaver
*Attorney, Agent, or Firm*—Henderson & Sturm

[57] ABSTRACT

A foldable container including a sheet of material is laid out in bottom, side, end, foldable gusset, and top panels. The panels are folded to form a seamless container having a lid that is selectively opened and closed by a zipper. The assembly container is essentially waterproof since the only seam is at the zipper. The sheet may be made of thermal insulating material resulting in a container that may be used to carry hot or cold foods and beverages. When not in use, the container may be unfolded and the panels may be refolded into a compact storage mode secured by elastic straps.

12 Claims, 7 Drawing Sheets

FOLDABLE CONTAINER

STATEMENT REGARDING FEDERALLY SPONSORED RESEARCH OR DEVELOPMENT

Not applicable.

CROSS REFERENCE TO RELATED APPLICATIONS

Not applicable.

REFERENCE TO MICROFICHE APPENDIX

Not applicable.

BACKGROUND OF THE INVENTION

1. Field of the Invention

The present invention relates to the field of containers, and more particularly to foldable containers.

2. Description of Related Art

As can be seen by reference to the following U.S. Pat. Nos. 3,246,829; 3,545,667; 4,235,346; 4,601,425; 4,846,398; and 5,284,294, the prior art is replete with myriad and diverse folding containers.

While all of the aforementioned prior art constructions are more than adequate for the basic purpose and function for which they have been specifically designed, they are uniformly deficient with respect to their failure to provide a simple, efficient, and practical folding container that is conveniently assembled for use and broken down for storage.

As a consequence of the foregoing situation, there has existed a longstanding need for a new and improved foldable container and the provision of such a construction is a stated objective of the present invention.

BRIEF SUMMARY OF THE INVENTION

Briefly stated, the present invention provides a foldable container including a sheet of material laid out in bottom, side, end, foldable gusset, and top panels. The panels are folded to form a seamless container having a lid that is selectively opened and closed by a zipper. The assembly container is essentially waterproof since the only seam is at the zipper. The sheet may be made of thermal insulating material resulting in a container that may be used to carry hot or cold foods and beverages. When not in use, the container may be unfolded and the panels may be refolded into a compact storage mode secured by elastic straps.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
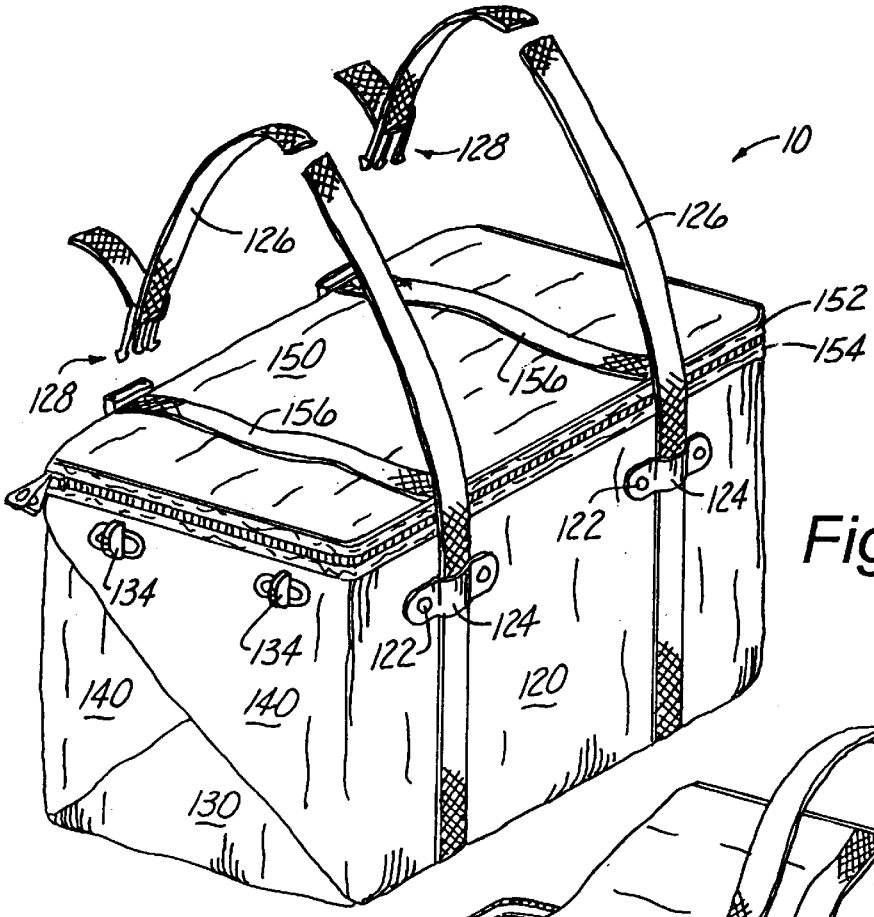
FIG. 1 is a front perspective view of the container of the present invention in its assembled mode with the lid closed and secured by a zipper closure.

As can be seen by reference to the drawings, and in particularly to FIG. 1, the container that forms the basis of the present invention is designated generally by the reference number 10. The container 10 is formed by folding the sheet of material 100 shown in the fully flat unfolded state in FIG. 3. FIG. 4 illustrates the construction of the sheet 100 including outer layers of thermally insulating light reflective film 102 encasing foam insulation layer 104 with the edges of the film 102 secured together by sewn piping 106.

The sheet 100 includes a bottom wall forming panel 110, a pair of opposing side wall forming panels 120, a pair of opposing end wall forming panels 130, four foldable gusset panels 140, and a top lid forming panel 150.

Figure 2:
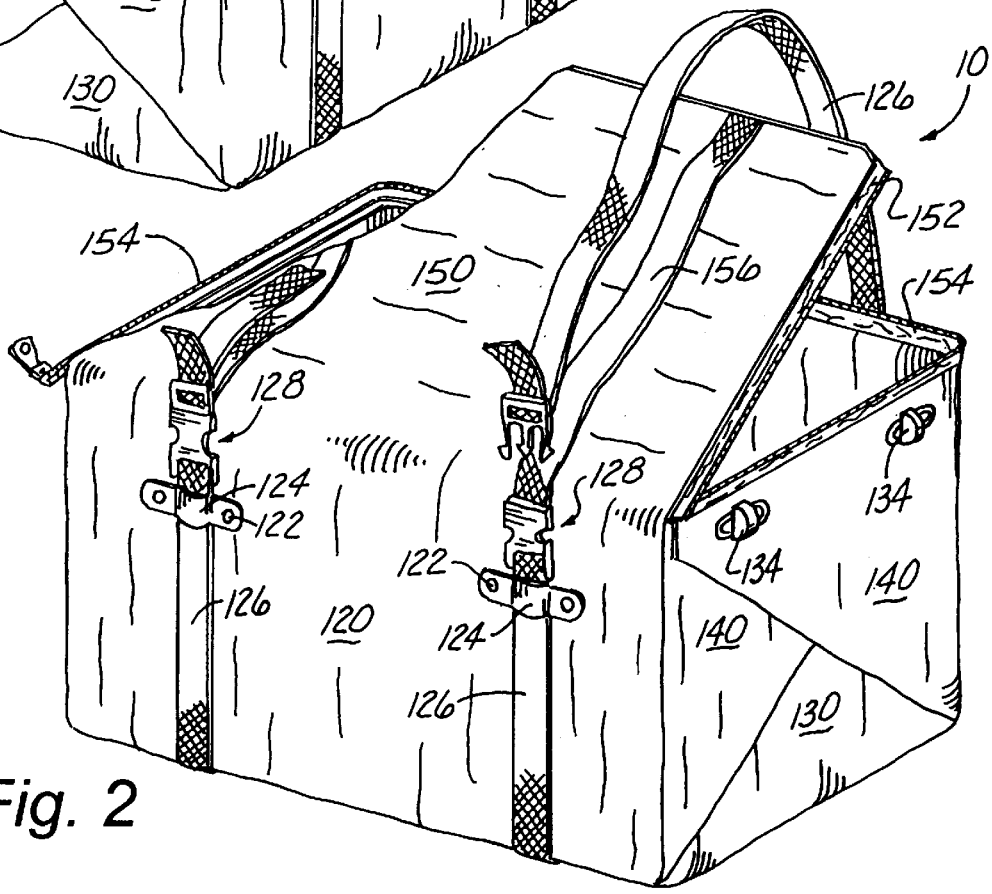
FIG. 2 is a rear perspective view of the container with a portion cut away showing the assembled container with the lid partially opened.

Side panels 120 carry rivets 122 that secure loops 124 on the outer surface (FIG. 14) to guide and hold carrying straps 126. The ends of carrying straps 126 are attached by releasable connectors 128 (FIG. 2).

Figure 14:
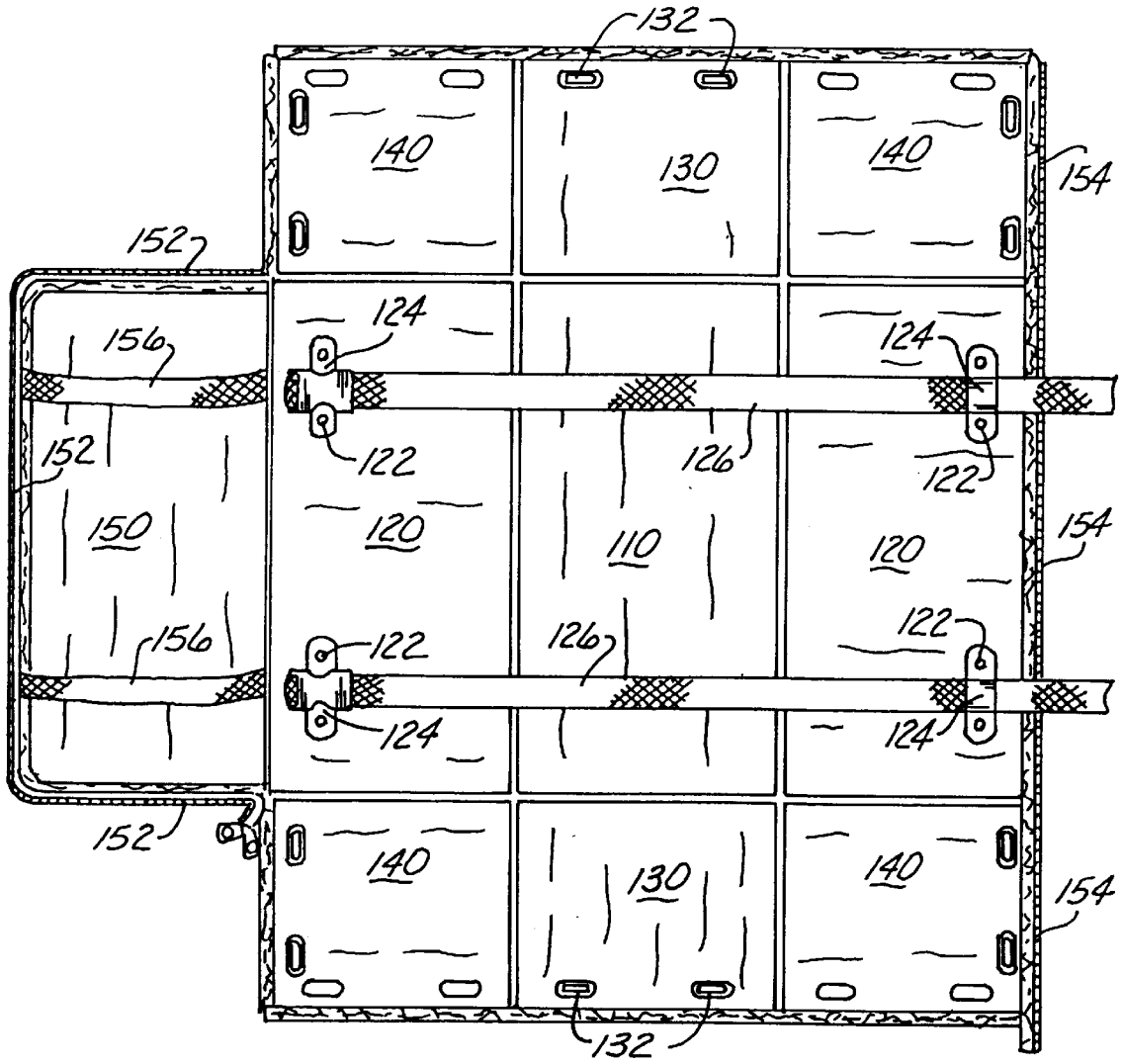
FIG. 14 is a bottom plan view of the sheet of folded material in the completely unfolded state, showing the opposite side of the sheet as shown in FIG. 3.

End panels 130 carry fasteners 132 that extend out from the outer surface (FIG. 14). The fasteners include movable end piece 134 (FIG. 2).

Gusset panels 140 have apertures 142 formed near the outer edges which are registerable when the panel 140 is folded along diagonal fold line 144.

The top lid panel 150 has a zipper element 152 attached to its outer edges, and the complementary zipper element 154 is attached to the distal edge of the opposite side panel 120 and the adjacent gusset panels 140. Elastic straps 156 are attached to and extend between edges of to panel 150 (FIG. 145).

Figure 3:
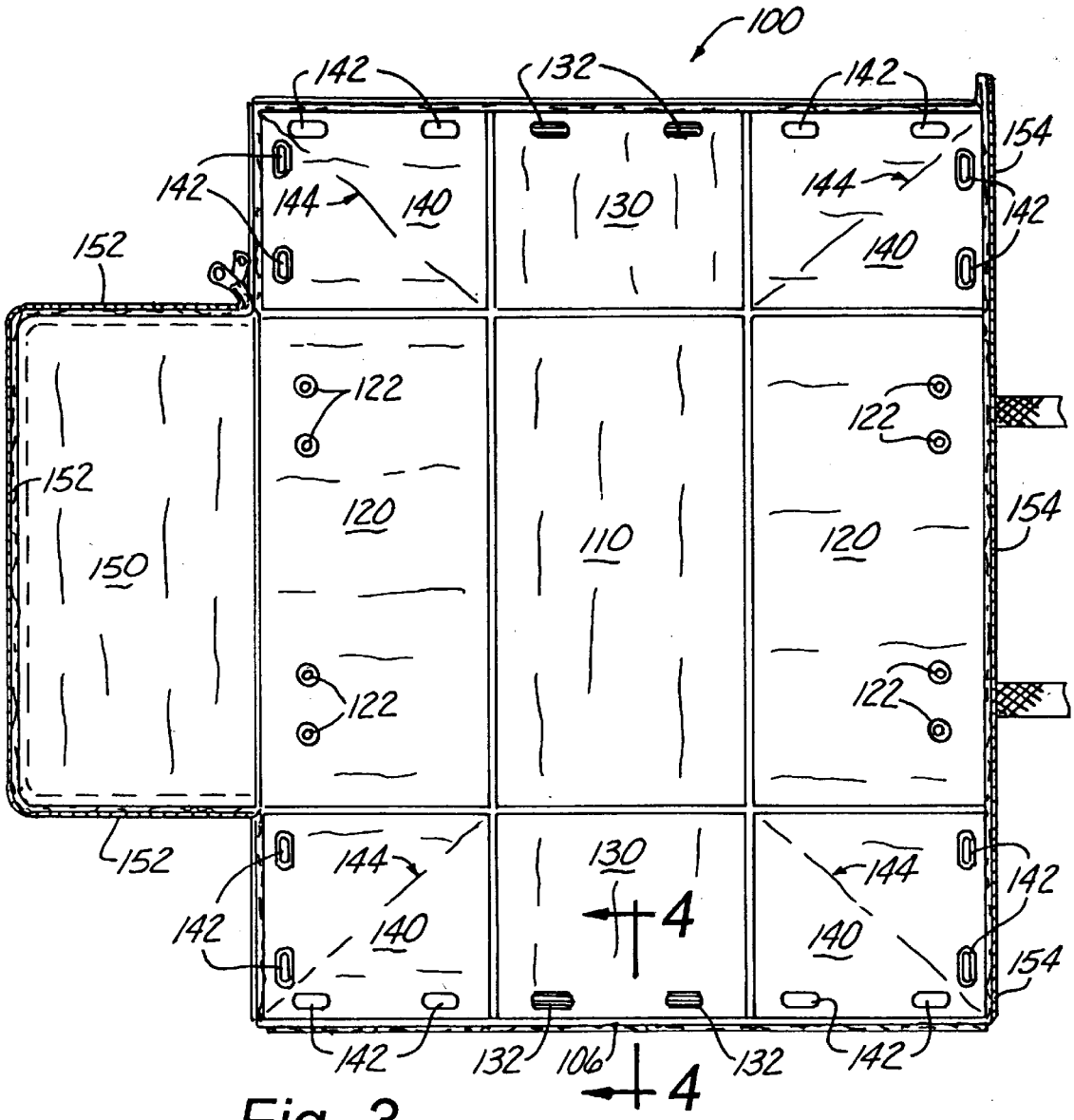
FIG. 3 is a top plan view of the sheet of foldable material that forms the container in a completely unfolded state.
Figure 4:
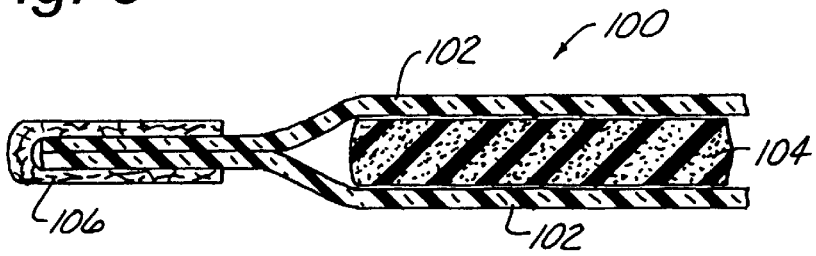
FIG. 4 is an enlarged sectional view taken along line 4—4 of FIG. 3 showing the construction of the sheet material.
Figure 5:
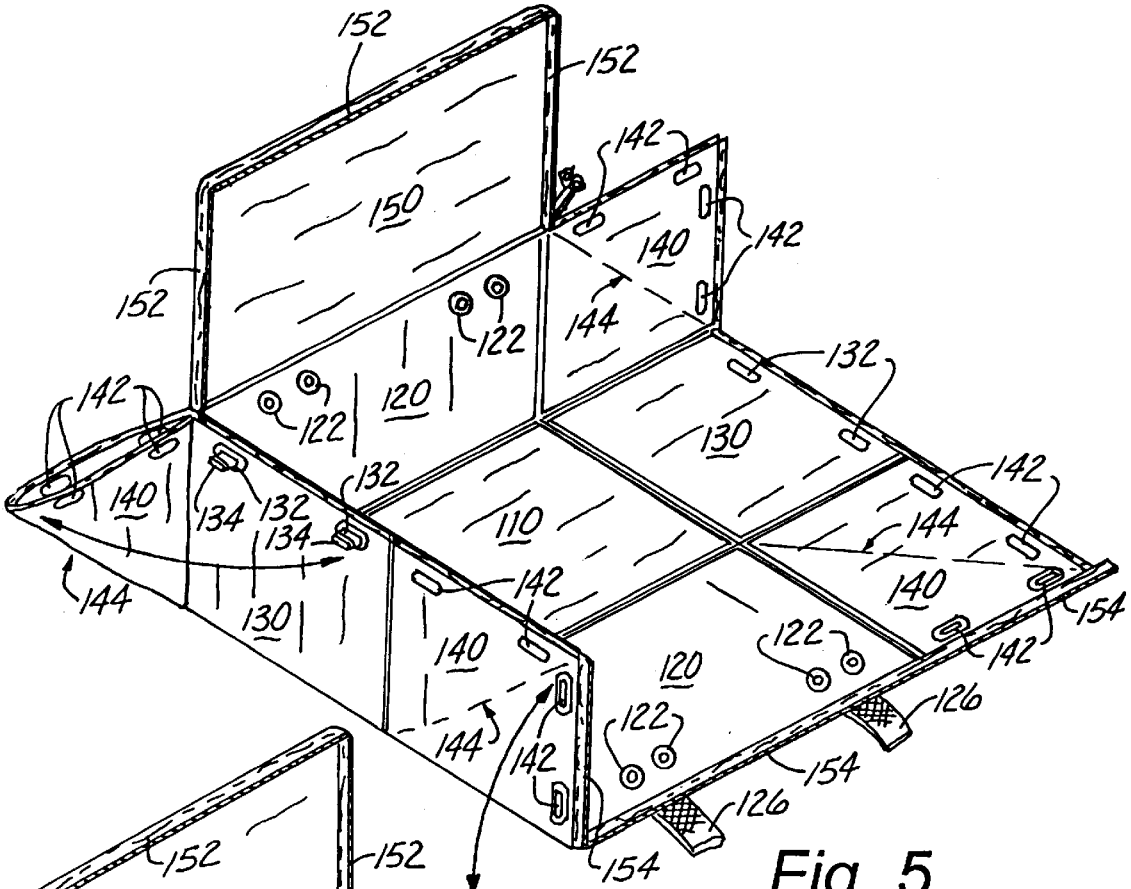
FIG. 5 is a front perspective view showing the initial folding of the panels to form a partially assembled container.
Figure 6:
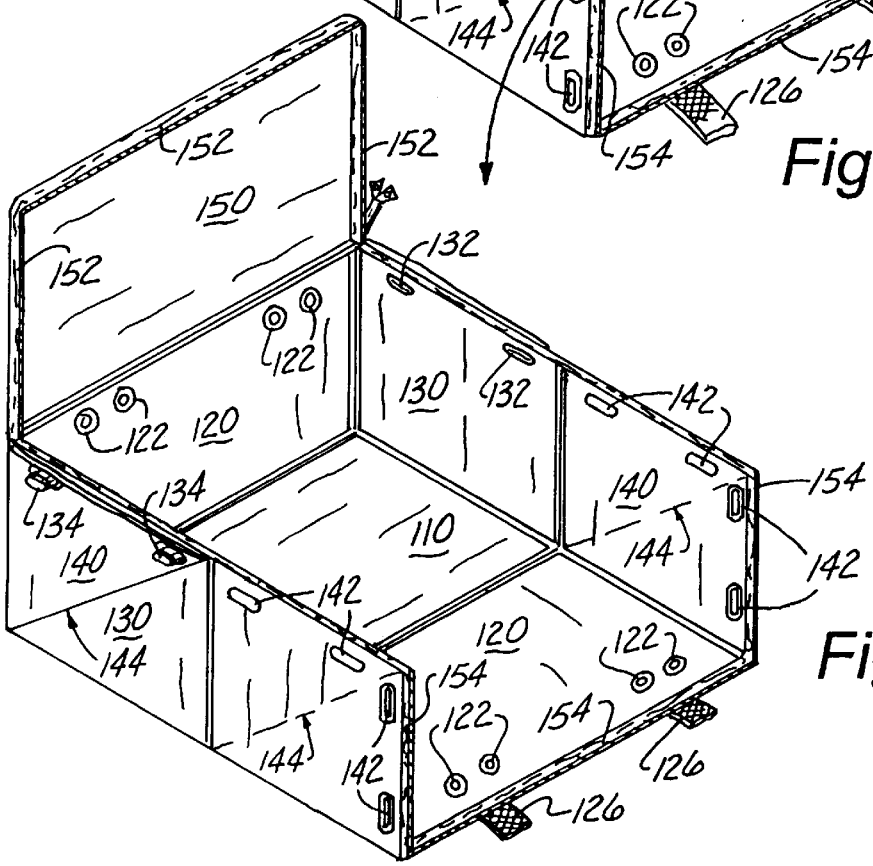
FIG. 6 is a front perspective view similar to FIG. 6, illustrating additional folding as the container assembly progresses.
Figure 7:
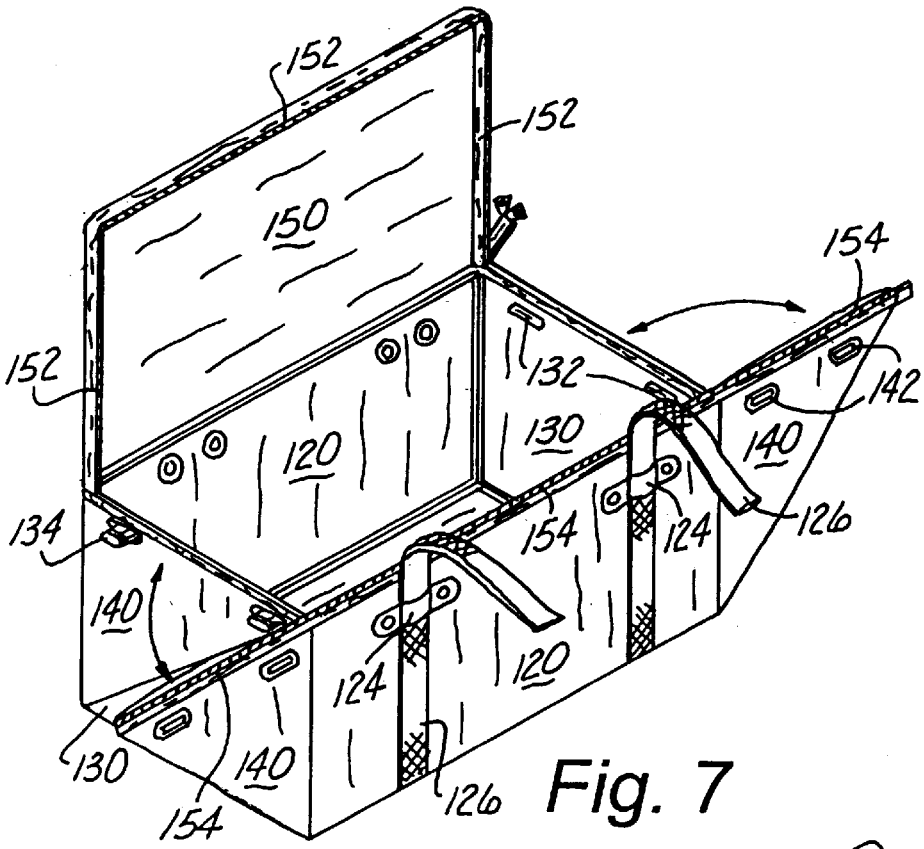
FIG. 7 is a front perspective view illustrating the final steps in the assembly process being undertaken.
Figure 8:
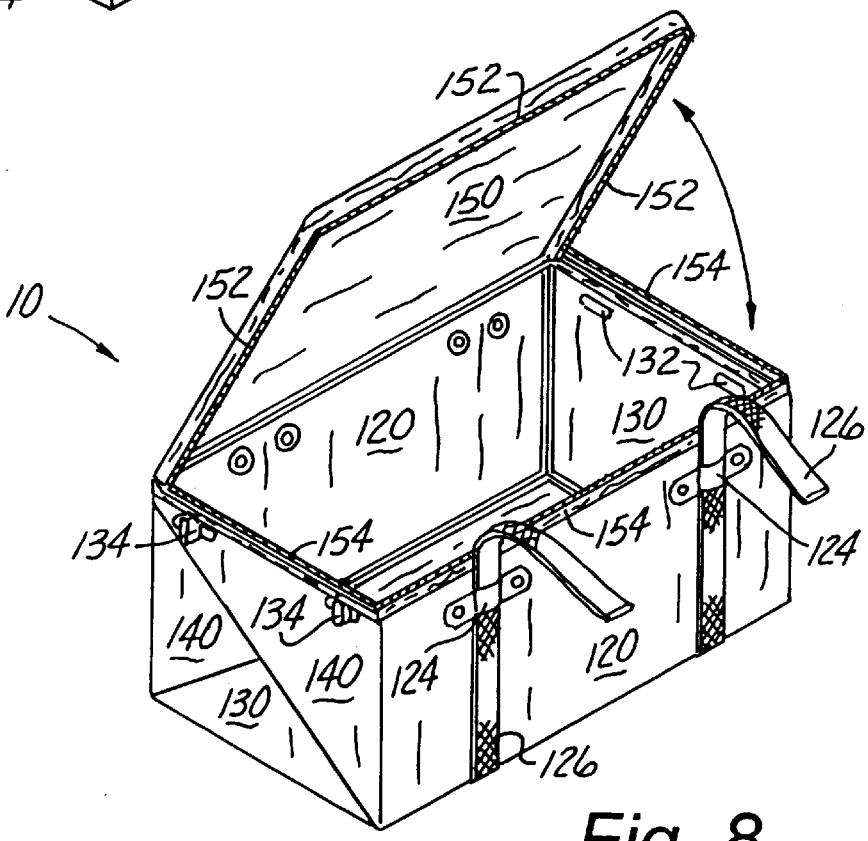
FIG. 8 is a front perspective view showing the assembled container with the lid in the open position.
Figure 9:
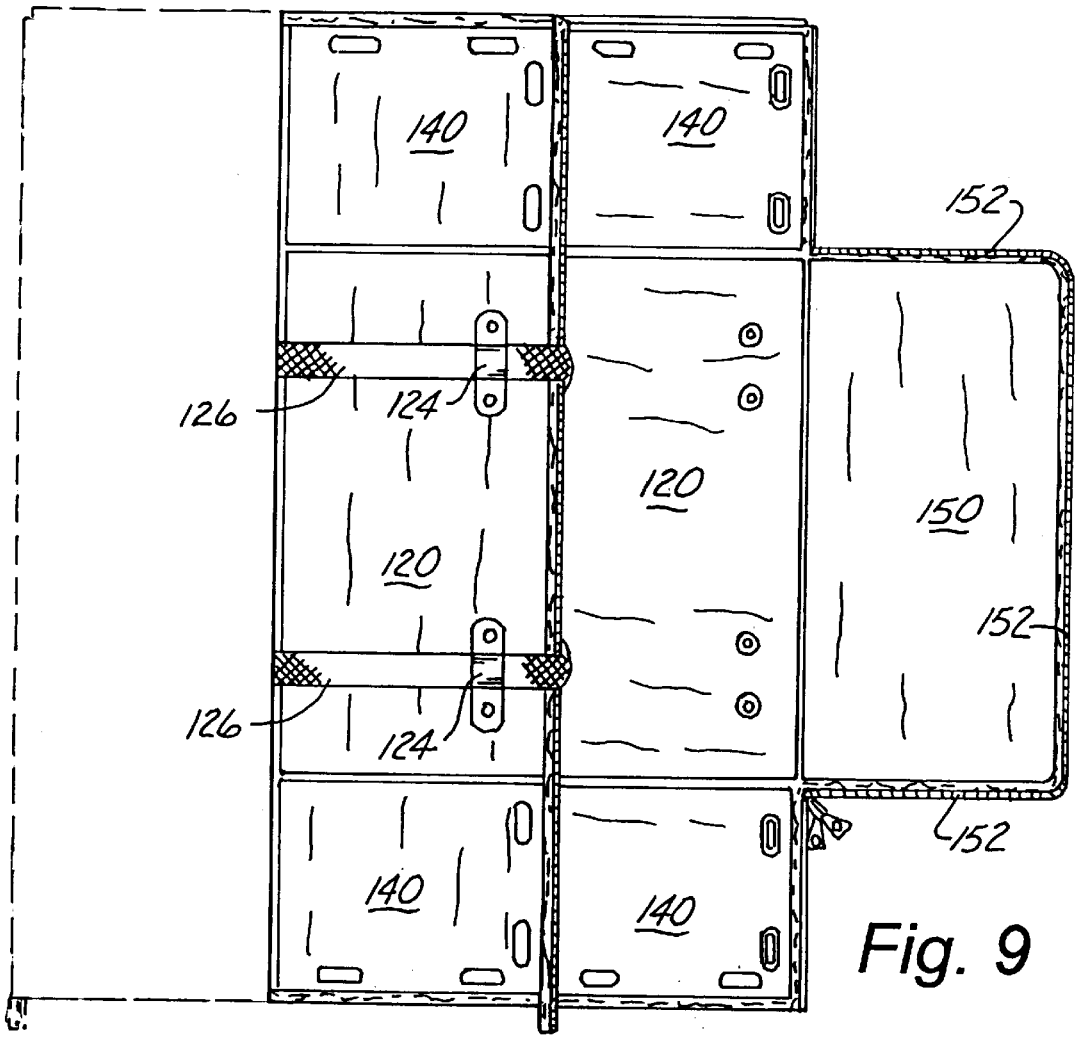
FIG. 9 is a top plan view similar to FIG. 3, but showing the initial folding of the panels from the completely unfolded state toward the compact storage mode.
Figure 10:
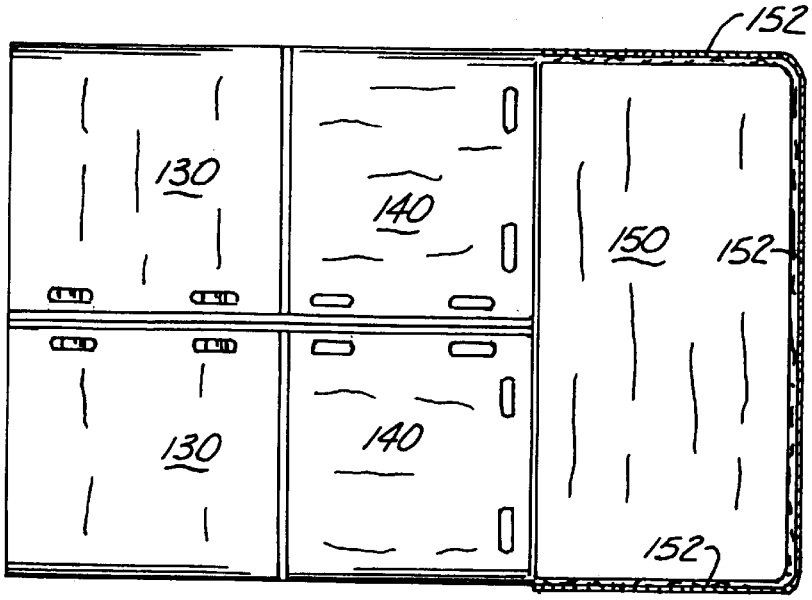
FIG. 10 is a top plan view illustrating additional folding toward the storage mode.
Figure 11:
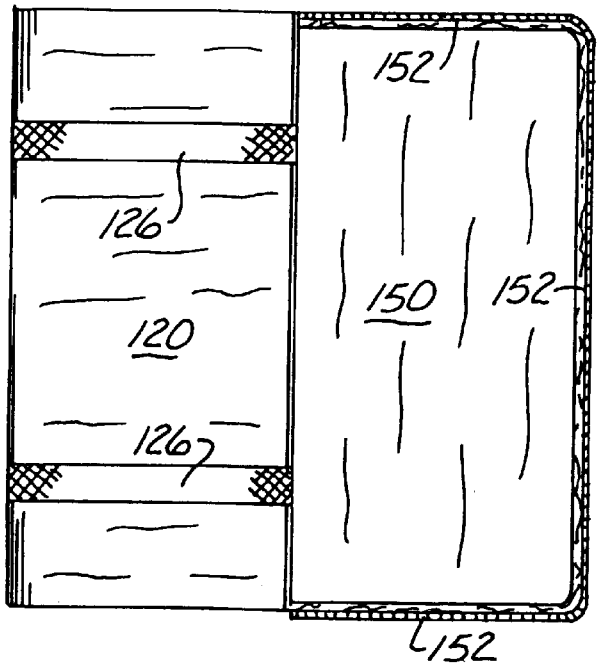
FIG. 11 is a top plan view illustrating the final step in the folding process.
Figure 12:
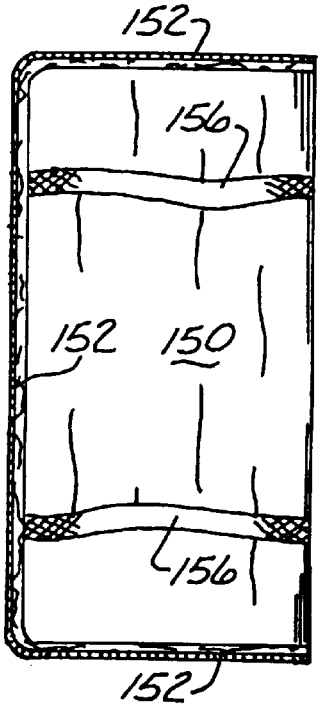
FIG. 12 is a top plan view showing the sheet fully folded to the storage mode.

To form the container 10, the sheet 100 is laid out flat and shown in FIG. 3. The panels are then folded in the sequence illustrated in FIGS. 5–7 to yield the assembled container 10 shown in FIG. 6. After inserting the fastener 132 through all of the registered apertures 142, the movable end piece 134 is rotated 90° so that it is offset from the apertures 142 and engages a section of the panel 140 adjacent the aperture 142. This secures the panels 140 against panel 130 to hold the container 10 in the assembled mode. The lid 150 is selectively opened or closed by use of the zipper closure 152,154.

Figure 13:
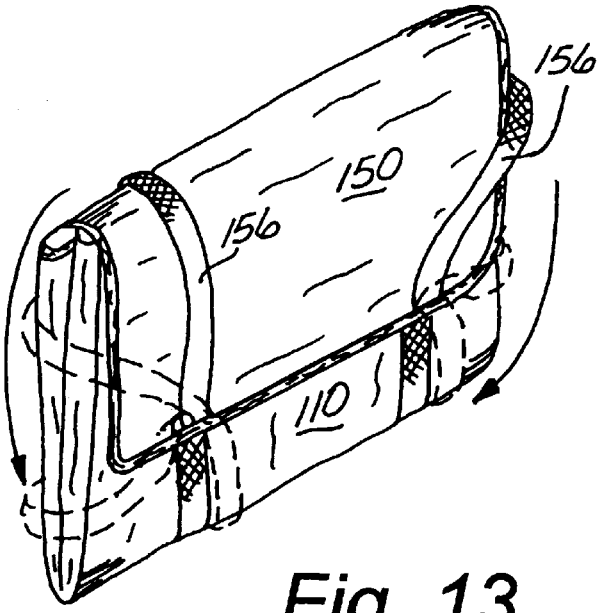
FIG. 13 is a front perspective view illustrating the positioning of the elastic straps to secure the sheet in the storage mode.

To break the container 10 down to the flat sheet 100, the end pieces 134 are rotated so that they are aligned with the apertures 142, and the panels are unfolded. To fold the sheet 100 into the compact storage mode shown in FIG. 13, the panels are sequentially folded as illustrated in FIGS. 9–12, and the elastic straps 156 are pulled over to the opposite side to secure the panels in position.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooded parts together, whereas, a screw employs a helical surface, in the environment of fastening wooden parts, a nail and a screw may be equivalent structures.

I claim:

1. A foldable container comprising:

a sheet of material, the sheet including:

a bottom rectangular panel;

a pair of opposing side panels foldably attached along respective proximal edges thereof to the bottom panel;

a pair of opposing end panels foldably attached along respective proximal edges thereof to the bottom panel and respectively interposed between the side panels about the periphery of the bottom panel;

four foldable gusset panels interconnecting adjacent edges of adjacent side and end panels; and a top panel foldably attached to a distal edge of one of the side panels;

means for releasably securing the outer edges of each of the gusset panels to the distal edge of its adjacent end panel; and a zipper closure including a first zipper element attached to the outer edges of the top panel, and a second complementary zipper element attached to the distal edge of the other of the side panels and the adjacent outer edge of its adjacent gusset panels.

2. The container of claim 1 wherein the releasable securing means includes:

apertures formed near the outer edges of each of the gusset panels, the apertures along each outer edge of each gusset panel being in register when the gusset panel is folded along a diagonal line extending out from the bottom panel; and fasteners attached near the distal edge of each end panel and being disposed to register with the apertures in the adjacent gusset panels when the gusset panels are folded to overlie the end panel.

3. The container of claim 2 wherein the sheet is formed of thermal insulating material.

4. The container of claim 2 wherein the fasteners include a shaft disposed to extend through registered apertures of the gusset panels, the shaft having a movable end piece movable between a first position in alignment with the apertures, and a second position offset from the apertures wherein the end piece is disposed to engage a portion of a gusset panel to secure the gusset panels to their respective end panels.

5. The container of claim 4 wherein the sheet is formed of thermal insulating material.

6. The container of claim 1 wherein an elastic strap is attached to and extends between the top panel proximal and distal edges.

7. The container of claim 6 wherein the sheet is formed of thermal insulating material.

8. The container of claim 1 wherein a carrying strap is attached to the side panels and extends around the top and bottom panels.

9. The container of claim 8 wherein the sheet is formed of thermal insulating material.

10. The container of claim 8 wherein ends of the carrying strap are attached by a releasable connector.

11. The container of claim 10 wherein the sheet is formed of thermal insulating material.

12. The container of claim 1 wherein the sheet is formed of thermal insulating material.

* * * * *